United States Patent [19]

Berke

[11] 4,164,081

[45] Aug. 14, 1979

[54] REMOTE TARGET HIT MONITORING SYSTEM

[75] Inventor: Herbert Berke, Maitland, Fla.

[73] Assignee: The United States of America as represented by the Secretary of the Navy, Washington, D.C.

[21] Appl. No.: 850,313

[22] Filed: Nov. 10, 1977

[51] Int. Cl.[2] ..... F41J 5/08

[52] U.S. Cl. ..... 35/25

[58] Field of Search ..... 273/85 G, 101.1, 101.2, 273/102.1 R, 102.2 B, 102.2 S, DIG. 28, 102.2 R; 35/12 N, 25; 358/104

[56] References Cited

U.S. PATENT DOCUMENTS

| | | | |
|---|---|---|---|
| 3,283,070 | 11/1966 | Prince | 35/12 N |
| 3,454,712 | 7/1969 | Mottram | 35/12 N |
| 3,515,802 | 6/1970 | Wise | 35/12 N X |
| 3,838,856 | 10/1974 | Takeya et al. | 273/101.1 |
| 4,034,990 | 7/1977 | Baer | 273/85 G |
| 4,083,560 | 4/1978 | Kikuchi et al. | 273/102.2 B |

FOREIGN PATENT DOCUMENTS

| | | | |
|---|---|---|---|
| 2360094 | 6/1975 | Fed. Rep. of Germany | 273/102.2 B |

*Primary Examiner*—Vance Y. Hum

*Attorney, Agent, or Firm*—Richard S. Sciascia; Robert W. Adams; David S. Kalmbaugh

[57] ABSTRACT

A marksman training system is disclosed as including a translucent diffuser target screen adapted for producing a bright spot on the rear surface of the target screen in response to receiving a laser light beam on the front side of the target screen that was fired from a laser rifle. A television camera scans the rear side of the target screen and produces a composite signal representing the position of the light spot on the rear surface of the target screen, after which the composite signal is broken into its X and Y Cartesian component signals and a video signal by a conventional television signal processor. The X and Y component signals consists of numbers of pulses which are shaped and then uniquely counted by digital counters, stored in registers, and converted to a pair of proportional analog voltage signals by digital-to-analog converters. A target recorder reads out the pair of analog voltage signals as a point, the location of which is comparable to the location on the target screen where it was hit by the laser light beam.

16 Claims, 4 Drawing Figures

REMOTE TARGET HIT MONITORING SYSTEM

FIELD OF THE INVENTION

The present invention, in general, relates to two-dimensional radiant energy detecting and display apparatus and, in particular, is a system which detects the position on a target that a light beam is received and effects the display thereof. In even greater particularity, the subject invention comprises a marksman training system which detects and records (perhaps remotely) the locations on a target where laser light beam "hits" are received during practice shooting sessions by a trainee marksman using a laser type simulated rifle or other weapon.

DESCRIPTION OF THE PRIOR ART

Heretofore, numerous devices have been used to display the "hit positions" from a light shooting gun on a target screen. Most shooting galleries, for instance, have such devices that are used in a game-like fashion. And, of course, they ordinarily work quite well for their intended purpose of providing entertainment to marksmen testing their shooting skill.

Moreover, as evidenced by U.S. Pat. No. 3,838,856 to Takeya et al, issued Oct. 1, 1974, entitled Target Display Using a Fresnel Lens to Amplify Signals from Light Beam Gun, prior art does exist that displays the "X" and "Y" coordinate positions of the "hits" from a laser or other light beam shooting rifle simulator. As inspection of the patent will disclose, the device shown therein is a target apparatus which is used with a light beam gun. When a light beam shot therefrom hits a transparent target and is then focused on a television pick-up tube by a fresnel lens, a rather complex electronic circuit processes the electrical signal equivalent thereof in such manner that the "X" and "Y" coordinate hit position on the target is represented by a proportional display thereof on an X-Y plotter.

Furthermore, in the art of radiation detection, television techniques have been employed to record the positions of various and sundry radiation events on which a television camera was sighted or directed and vice versa. Thus, many television systems could be considered to be prior art, as far as this particular case is concerned. However, the complexity and expense leaves a great deal to be desired, as far as target "hit" indicators are concerned.

SUMMARY OF THE INVENTION

The subject invention overcomes some of the disadvantages of the prior art—especially for its intended purpose—in that it is of much simpler construction and more economical to manufacture and use. Very briefly, it comprises a laser rifle training system which provides "hit" or "miss" indication with respect to a target fired at by a trainee rifleman with a simulated rifle that shoots laser beams instead of real bullets. Incorporated therein is a television camera that is located behind a translucent screen containing target indicia on the front side thereof. When a laser rifle is aimed thereat and fired, the laser light therefrom is picked up by the television camera and converted to horizontal and vertical sync signals. These horizontal and vertical sync signals are then used to respectively reset and provide clock pulses to a pair of counters that count continuously. When a "hit" is sensed by the television camera, horizontal and vertical storage and hold registers timely transfer or dump the counts from the counters—respectively representing "X" and "Y" coordinate distances from predetermined vertical and horizontal reference datums—to horizontal and vertical digital-to-analog converters, respectively. They, in turn, generate "X" and "Y" Cartesian coordinate voltage signals respectively proportional thereto which are recorded by a target "hit" readout, probably located at some place remote from the aforesaid translucent screen, say, somewhere near the trainee rifleman. Obviously, the observing of the readout by the rifleman, immediately makes him aware of his shooting accuracy and, thus, facilitates his taking whatever action as would be necessary to effect the improvement thereof.

It is, therefore, an object of this invention to provide an improved marksman training system.

Another object of this invention is to provide an improved means for electronically detecting and indicating the position on a target of a laser or other light beam that has been shot from a simulated weapon with high resolution and fidelity.

Still another object of this invention is to provide an improved means for monitoring where laser rifle shots have been received by a target that is spatially and perhaps remotely disposed from the display thereof.

Other objects and many of the attendant advantages of this invention will be readily appreciated as the same becomes better understood by reference to the following detailed description, when considered in connection with the accompanying drawings.

DESCRIPTION OF THE PREFERRED EMBODIMENT

Figure 1:
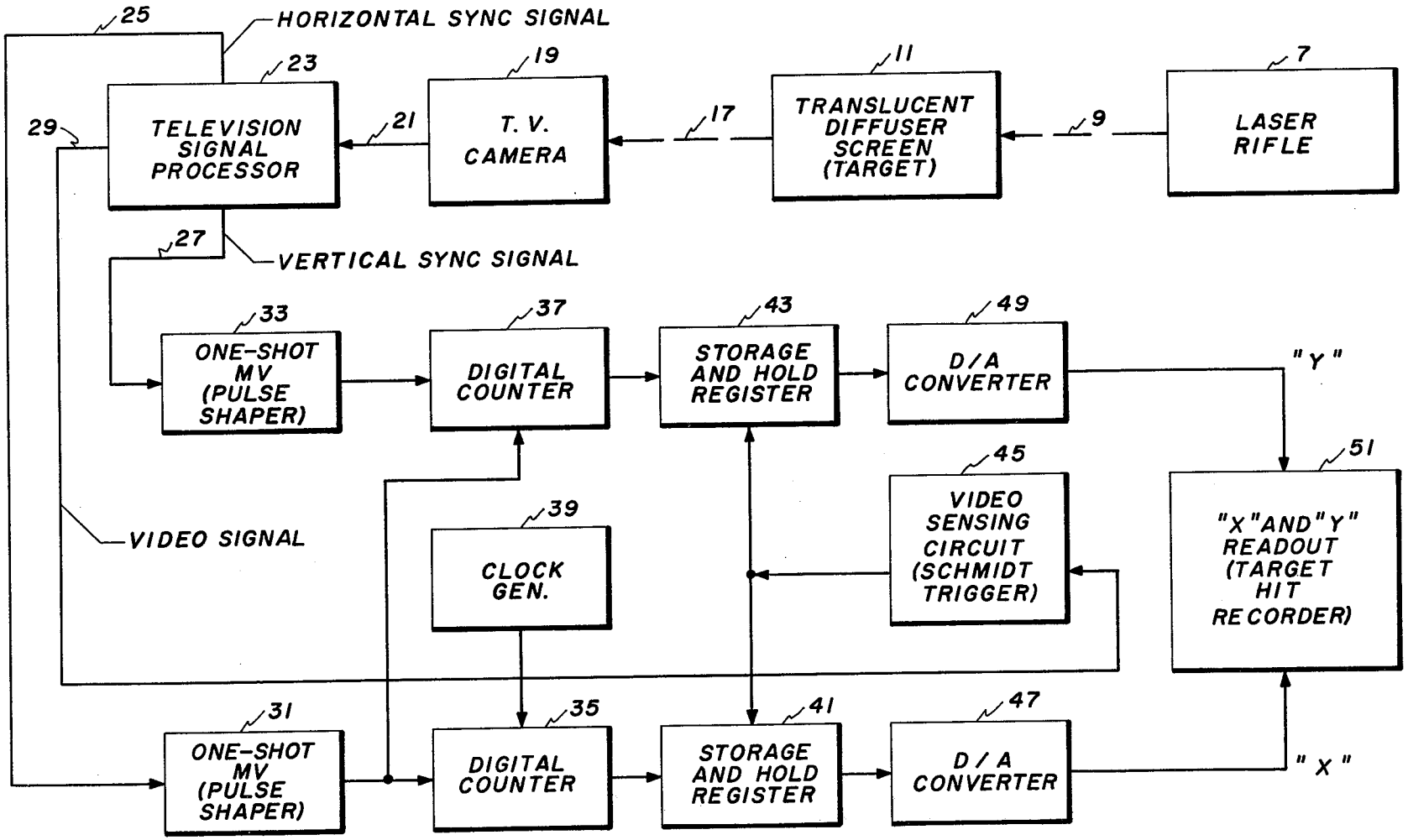
FIG. 1 consists of a block diagram of the marksmanship display and training system constituting the subject invention.
Figure 2:
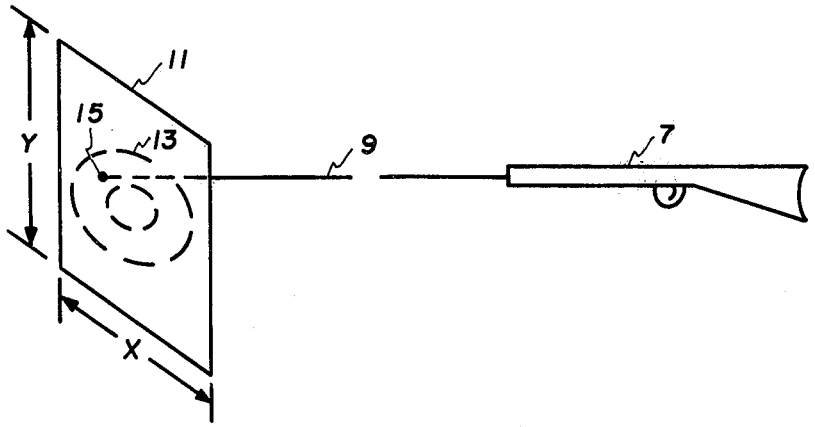
FIG. 2 illustrates schematically the target-laser rifle relationship incorporated in the invention.

Referring now to FIGS. 1 and 2, there is shown a laser rifle 7, which, of course, is a rifle that simulates a real gun but shoots laser beams (or perhaps other coherent collimated light beams) instead of bullets whenever the trigger thereof is pulled by a marksman (not shown). Hence, rifle 7 is capable of shooting a laser light beam 9 toward a translucent diffuser screen 11 (defined by "X" and "Y" axes) having target indicia 13 on the front side thereof, and when laser light beam 9 is received thereby, a bright spot image 15 is impressed thereon and on the target pattern thereof. Obviously, the relationship of spot 15 with respect to, say, the "bullseye" of indicia 13 of target 11 would be indicative of the skill of the marksman, as best seen in FIG. 2.

In any event, light 17 from spot 15 would be picked up by a television camera 19 sighted on the rear surface of translucent diffuser screen 11 as a consequence of the light diffusion characteristics of the latter and the inherent operational characteristics—effected by lenses, electronic sensors, etc.—of the former, as best seen in FIG.

1. Of course, television camera 19 produces a composite signal 21 at the output thereof which represents the existence and location of a laser light spot on screen 11, whenever such spot is present thereon.

The output of television camera 19 is connected to the input of a conventional television signal processor 23 that converts composite signal 21 to three separate and distinct signals, namely: (1) a signal representing the horizontal distance spot 15 is located with respect to a predetermined reference position on screen 11, herewith defined as being a horizontal sync signal 25; (2) a signal representing the vertical distance spot 15 is located with respect to a predetermined reference position on screen 11, herewith defined as being a vertical sync signal 27; and (3) a signal representing the presence and nonpresence of spot 15 on screen 11 at any given instant, herewith defined as being a video signal 29. For purposes of emphasis, it would perhaps be noteworthy with respect to the last mentioned video signal that it is only present when screen 11 is actually receiving laser light beam 9 on the front and target side thereof.

Although a number of such television processors—that is ones that produce such sync and video signals—are available commercially, one that is emanently suited for use in the instant invention is Television Processor No. MC1344P, manufactured by Motorola Semiconductor Products, Inc., Phoenix, Ariz.

The horizontal and vertical sync signal outputs are respectively connected to the inputs of a pair of one-shot multivibrators 31 and 33, both of which are designed to act as pulse shapers which produce pulses of appropriate and useful configuration. The output of one-shot multivibrator 31 is connected to the reset input of a continuously running digital counter 35 and the clock input of a digital counter 37, with the reset input of digital counter 37 being connected to the output of one-shot multivibrator 33. A clock signal generator 39 has its output connected to the clock input of digital counter 35. It may, of course, be designed to produce any desired clock signal frequency, but it has been found that something on the order of five million cycles per second is quite satisfactory. Obviously, it would be well within the purview of the artisan having the benefit of the teachings presented herewith to select whatever clock frequency signal for clock generator 39 as would be necessary to optimize the operation of the subject invention for any given purpose. Accordingly, the aforementioned five million cycles per second is not intended to be limiting, as far as this invention is concerned.

The outputs of digital counters 35 and 37 are connected to the data inputs of storage and hold registers 41 and 43, respectively; and the gating and clearing inputs of storage and hold registers 41 and 43 are interconnected and connected to the output of a Schmitt trigger circuit 45, the input of which is connected to the video signal output of television signal processor 23. In this particular instance, of course, Schmitt trigger 45 constitutes a video signal sensing and shaping circuit, and it only produces a signal at the output thereof when a video signal is present at the output of television signal processor 23. Hence, in some respects, it, too, could be considered as being a pulse shaper which shapes the output signal thereof in such manner that it would be compatible with and timely actuate storage and hold registers 41 and 43 in such manner as to effect the timely gating and clearing thereof, as is conventional with respect thereto.

The outputs of storage and hold registers 41 and 43 are respectively connected to the inputs of digital-to-analog converters 47 and 49, and the outputs thereof are respectively connected to the "X" and "Y" coordinate signal inputs of a readout 51 which, in fact, would constitute a target "hit" recorder, as far as the subject marksman training system is concerned. Readout 51, of course, may be any conventional indicator, plotter, recorder, or the like, such as, for example, Model 7010A X-Y Recorder manufactured by the Hewlett Packard Company of Palo Alto, Calif.

Although citations have been presented with regard to the manufacturers of various ones of the above mentioned elements and components, it should be understood that all thereof represented in block form in FIG. 1 are well known, conventional, and commercially available, per se; hence, it is, likewise, to be understood that it is their new, unique, and unobvious interconnections and interactions which effect the new combination of elements that constitutes this invention and makes it produce the above stated results and, thus, achieve the above stated objectives.

Figure 3:
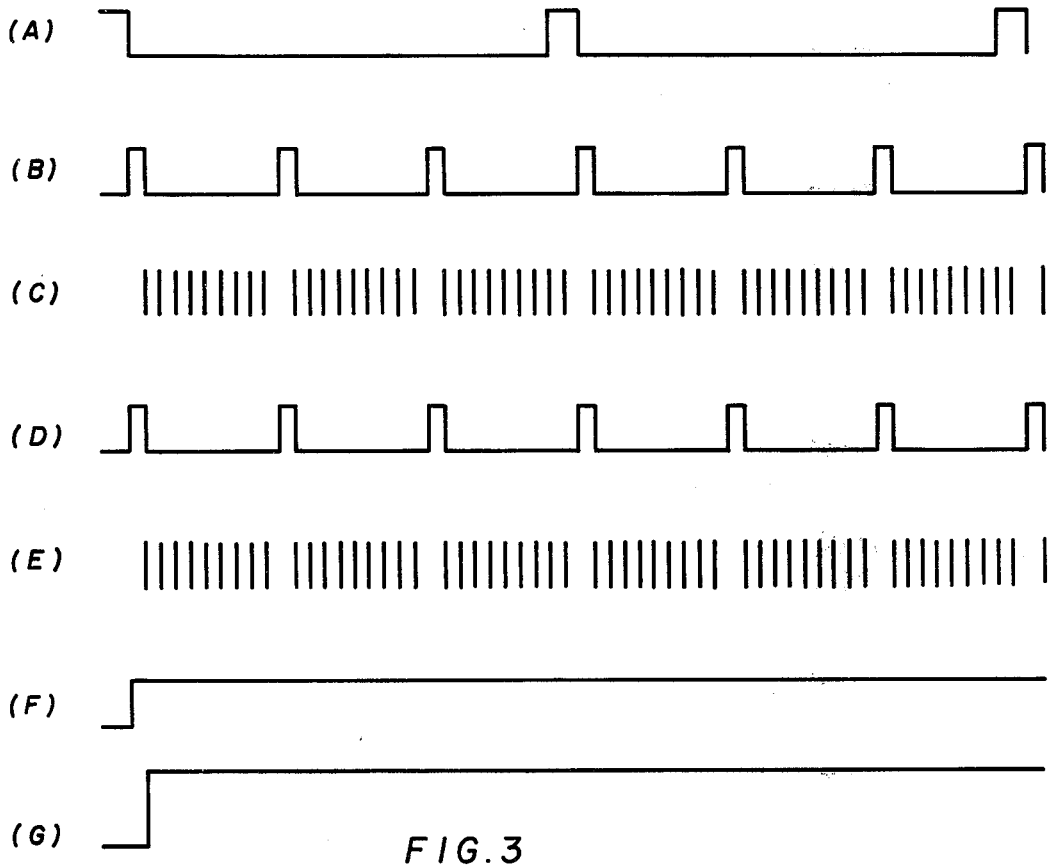
FIG. 3 graphically depicts some of the representative signal waveforms—shown in idealized form—which occur at the outputs of some of the elements of the instant invention.
Figure 4:
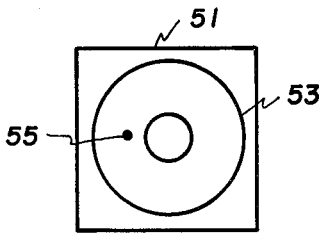
FIG. 4 discloses a representative remote monitor or readout which displays target "hits" of trainee marksman.

FIGS. 2 through 4 will be discussed below in connection with the discussion of the operation of the invention. Insofar as practical, like parts in the devices respectively shown therein will be represented by like reference numerals.

MODE OF OPERATION

The operation of the invention will now be discussed briefly in conjunction with FIGS. 1 through 4.

Because television camera 19 is trained on the rear surface of translucent diffuser screen 11, it constantly supplies a composite signal to television signal processor 23 which represents the "X" and "Y" distance of light spot 15 appearing thereon with reference to predetermined vertical and horizontal datum lines, respectively, whenever laser rifle 7 is fired. Of course, inasmuch as laser rifle 7 is aimed at the center of the target indicia 13 (or bullseye area), laser light beam 9 impacts on front surface of screen 11, thereby generating said bright spot 15 on the rear surface thereof, due to the light diffusion characteristics thereof.

Accordingly, television signal processor 23 converts composite signal 21 into its horizontal "X" sync signal 25, its vertical "Y" sync signal component 27, and its video signal 29, with the latter thereof only occurring at those times when light spot 15 occurs on the rear face of screen 11. In other words, video signal 29 is only produced when light spot 15 is present somewhere on screen 11.

In effect, after being properly shaped by one-shot multivibrator 33, the vertical sync signal constitutes a series of reset pulses similar to those shown in FIG. 3(A); and, in effect, after being shaped by one-shot multivibrator 31, the horizontal sync signal constitutes a series of pulses similar to those shown in FIG. 3(B). Each pulse of the latter, of course, represents each horizontal scan line which occurs effectively within each scan frame of television camera 19, and the former, of course, represents each frame scan or total scan cycle that occurs with respect to, say, some upper left-hand reference flyback position of camera 19. Accordingly, it may readily be seen that all of the horizontal scan lines that occur from top to bottom of one frame scan of camera 19 (during one traverse of screen 11) also occur between the shaped vertical sync signal reset pulses which emanate from the output of one-shot multivibrator 33. Therefore, it may be considered that between the reset pulses from one-shot multivibrator 33, digital counter 37 could count all of the scan lines of the screen traversed by camera 19, if a "count" pulse were supplied thereto every time a horizontal scan line occurred. In other words, a horizontal sync signal from television signal processor 23 is generated thereby every time a scan line occurs in camera 19, and when shaped to be a pulse by one-shot multivibrator 31, it may be seen that a series of pulses result which represent the number of scan lines that have occurred at any given instant. These pulses are supplied to the count input of digital counter 37 whenever camera 19 performs its horizontal line scanning function—which, for all practical purposes, may be considered as being continuous when camera 19 is turned on. Thus, because digital counter 37 runs constantly between periodic resets, the number of horizontal scan lines at any given instant between resets is constantly being counted, and such counts are proportional to the "Y" coordinate distance that occurs at any given instant.

Whenever TV camera 19 senses a laser light spot (representing a laser rifle shot) on the back of screen 11, video signal 29 is produced by television signal processor 23, and video signal 29 triggers Schmitt trigger 45, so as to effect the shaping thereof to the extent that it will actuate or gate storage and hold register 43 and permit digital counter 37 to timely dump whatever count exists therein at that particular moment—say the pulses shown in FIG. 3(D)—and then, shortly thereafter, cause storage and hold register 43 to be cleared, in preparation for receiving new count data a moment or so later.

Digital-to-analog converter 49 converts whatever digital count exists in storage and hold register 43 into an analog voltage signal —similar to that shown in FIG. 3(F)—proportional thereto, and the proportional analog voltage signal—being, likewise, proportional to the "Y" coordinate distance from the top datum of screen 11—represents the vertical distance downward to on screen 11 which was caused by the firing of laser rifle 7 by a marksman. When applied to the "Y" input of target hit recorder 51—which, of course, preferably contains target indicia 53 on the readout portion thereof that is comparable to that referenced above as indicia 13 on screen 11—a spot 55 marking the "Y" axis distance is generated thereby in coordination with an "X" distance spot marking thereby, the initial effecting signal of which will be discussed now.

As indicated above, vertical sync signal 27 constitutes a count of the number of camera scan frames that have occurred since the initial zero reference scan point to which the final scan line flyback goes at the end of each cyclical screen scan frame. And, as shall now be explained again, horizontal sync signal 25 produces pulses—after being properly shaped by one-shot multivibrator 31—each of which occurs at the beginning of every horizontal line scan of camera 19. Thus, it may readily be seen that if, for example, camera 19 scans 525 horizontal lines—interlaced or not—per scan frame or screen traverse, then 525 pulses (like those shown in FIG. 3(B)) would occur at the output of one-shot multivibrator 31 for every pulse (like those shown in FIG. 3(A)) which would occur at the output of one-shot multivibrator 33. Hence, it may readily be seen that although these 525 pulses constitute clock counts as far as digital counter 37 is concerned, they constitute reset pulses as far as digital counter 35 is concerned. Being such reset pulses, they reset digital counter 35 to zero every time one thereof occurs. Therefore, in order for digital counter 35 to generate a digital signal that represents the "X" coordinate distance from the beginning of the scan of each scan line (at the left hand reference datum line of television camera 19 and screen 15) to any spot occurring on screen 11 as a consequence of laser rifle 7 being fired, a count of predetermined frequency clock pulses (such as those shown between resets in FIG. 3(C)) must be made. To effect such counting, clock generator 39 provides the clock pulses to be counted between resets of digital counter 35. In other words, between reset pulses, digital counter 35 counts the number of clock generator pulses supplied thereto during the scanning of each horizontal line by camera 19, and the number of clock pulses counted thereby—represented very simply by FIG. 3(C)—is proportional to the "X" coordinate distance from the left hand reference edge of screen 11 at which laser light spot 15 occurs.

This "X" count is constantly being fed to storage and hold register 41 because, like digital counter 37, digital counter 35 runs continuously. But, when storage and hold register 41 is actuated or gated by video sensing circuit (Schmitt trigger) 45, whatever count—as very simply represented by FIG. 3(E)—as is present in digital counter 35 at that particular instant is dumped into it, after which it is cleared by the trailing edge of the video signal pulse from Schmitt trigger 45. Before being cleared, however, digital-to-analog converter 47 converts said count into an analog voltage signal—similar to that shown in FIG. 3(G)—that is proportional thereto, with said analog voltage signal being representative of the "X" coordinate distance to laser light spot 15. When applied to the "X" input of "X" and "Y" readout 51, it causes it to generate another spot—in conjunction with the "Y" signal—which is represented by FIG. 3(F)—that, in turn, provides a "hit" indication 55 with respect to target indicia 53 located on readout 51—which, of course, is correlated with target indicia 13 of screen 11. Therefore, target hit recorder 51 reads out where laser light beam 9 from gun 7 hits screen 11.

Because storage and hold registers 41 and 43 are effectively gated simultaneously by video signal 29, both the "X" and "Y" Cartesian coordinate signals—that is, the direct voltages of the signals of both FIG. 3(G) and FIG. 3(F)—from digital-to-analog converters 47 and 49, respectively, are supplied to readout 51 at the same time and only when laser rifle 7 has been fired. And that is true, even though digital counters 35 and 37 are running continuously, as previously mentioned.

Since readout 51 is or may be physically positioned near the marksman firing rifle 7, he may more easily observe exactly where he is hitting the target marked on screen 11 and make aiming corrections accordingly, so as to improve his shooting skill more rapidly than he would if he had to walk to the target each time or view it through binoculars, etc., after each rifle firing, in order to make actual target "hit" observations.

From the foregoing, it may readily be seen that a relatively simple but highly accurate method and means for providing target "hit" indications has been disclosed herein which ostensively advances the state of the art.

Obviously, many modifications and variations of the present invention are possible in the light of the above teachings. It is, therefore, to be understood that within the scope of the appended claims, the invention may be practiced otherwise than as specifically described.

What is claimed is:

1. A remote target hit monitoring system, comprising in combination:

a translucent diffuser screen having target indicia on one side thereof that is adapted for having a laser light beam shot thereat;

a television camera spatially disposed from said translucent diffuser screen and sighted on the side thereof that is opposite the side which contains said target indicia;

a television signal processor having an input and a plurality of outputs, with the input thereof connected to the output of said television camera;

a first one-shot multivibrator connected to one of the outputs of said television signal processor;

a second one-shot multivibrator connected to another of the outputs of said television signal processor;

a Schmitt trigger connected to still another output of said television signal processor;

a first digital counter having a reset input, a clock input, and an output, with the reset input thereof connected to the output of said first one-shot multivibrator, and with the clock input thereof connected to the output of said second one-shot multivibrator;

a clock generator;

a second digital counter having a reset input, a clock input, and an output, with the reset input thereof connected to the output of said second one-shot multivibrator, and with the clock input thereof connected to the output of said clock generator;

a first storage and hold register having a data input, a gating and clearing input, and an output, with the data input thereof connected to the output of said first digital counter, and with the gating and clearing input thereof connected to the output of the aforesaid Schmitt trigger;

a second storage and hold register having a data input, a gating and clearing input, and an output, with the data input thereof connected to the output of said second digital counter, and with the gating and clearing input thereof connected to the output of the aforesaid Schmitt trigger;

a first digital-to-analog converter connected to the output of said first storage and hold register;

a second digital-to-analog converter connected to the output of said second storage and hold register; and a readout connected to the outputs of said first and second digital-to-analog converters.

2. The invention of claim 1, further characterized by means spatially disposed from said translucent diffuser screen for shooting said laser light beam at the one side thereof containing the aforesaid target indicia.

3. The system of claim 2, wherein said means spatially disposed from said translucent diffuser screen for shooting said laser light beam at one side thereof containing the aforesaid target indicia comprises a laser beam firing weapon.

4. The system of claim 2, wherein said means spatially disposed from said translucent diffuser screen for shooting said laser light beam at one side thereof containing the aforesaid target indicia comprises a laser rifle.

5. The system of claim 2, wherein said means spatially disposed from said translucent diffuser screen for shooting said laser light beam at one side thereof containing the aforesaid target indicia comprises a laser gun.

6. A target hit indicator comprising in combination:

means for receiving the laser light from a laser weapon and for producing a light spot thereon in response thereto;

means for scanning a predetermined frame of said laser light receiving means, having a horizontal sync signal output, a vertical sync signal output, and a video signal output, for producing a horizontal sync signal, a vertical sync signal, and a video signal in response to the presence of said light spot thereon;

a first one-shot multivibrator having an input effectively connected to the vertical sync signal output of said predetermined frame scanning means, and an output;

a second one-shot multivibrator having an input effectively connected to horizontal sync signal output of said predetermined frame scanning means, and an output;

a first digital counter having a reset input, a clock input, and an output, with the reset input effectively connected to the output of said first one-shot multivibrator, and with the clock input effectively connected to the output of said second one-shot multivibrator;

a second digital counter having a reset input, a clock input, and an output, with the reset input effectively connected to the output of said second one-shot multivibrator;

a clock signal generator, having an output connected to the clock input of said second digital counter;

a first storage and hold register having a data input, a gating and clearing input, and an output, with the data input effectively connected to the output of said first digital counter;

a second storage and hold register having a data input, a gating and clearing input, and an output, with the data input effectively connected to the output of said second digital counter;

a Schmitt trigger, having an input effectively connected to the video signal output of the predetermined frame scanning means, and an output effectively connected to the gating and clearing inputs of said first and second storage and hold registers;

a first digital-to-analog converter having an input connected to the output of said first storage and hold register and an output;

a second digital-to-analog converter having an input connected to the output of said second storage and hold register and an output; and means having a first input connected to the output of said first digital-to-analog converter, and a second input connected to the output of said second digital-to-analog converter, for reading out an "X" and a "Y" coordinate distance signal simultaneously as a composite combination thereof which represents the position of said light spot within said predetermined frame.

7. The device of claim 6, wherein said means for receiving the laser light from a laser weapon and for producing a light spot thereon in response thereto comprises a translucent diffuser screen having target indicia on the front side thereof.

8. The device of claim 6, wherein said means for scanning a predetermined frame of said laser light receiving means comprises:

a television camera; and a television signal processor connected to the output of said television camera.

9. The device of claim 6, wherein said means for reading out an "X" and a "Y" coordinate distance signal simultaneously as a composite combination thereof which represents the position of said light spot within said predetermined frame comprises a target hit indicator.

10. A marksman training system, comprising in combination:

means adapted for shooting a predetermined laser light beam in response to a predetermined first signal;

a translucent diffuser target screen adapted for producing a light spot on the rear side thereof in response to a laser light beam received by the front side thereof that was shot from said laser light beam shooting means;

a television camera adapted for producing a composite signal that represents the disposition of said light spot with respect to a predetermined first horizontal reference datum and a predetermined first vertical reference datum on the rear side of said translucent diffuser target screen whenever said light spot appears thereon;

a television signal processor having an input connected to the output of said television camera, having a first sync signal output, a second sync signal output, and a video signal output, for converting the composite signal produced thereby into a first sync signal, having whatever number of consecutive, uniformly spaced pulses, that is proportional to the vertical distance said spot is located from said predetermined horizontal reference datum on said translucent diffuser target screen, a second sync signal, having whatever number of consecutive, uniformly spaced pulses, that is proportional to the horizontal distance said spot is located from said predetermined vertical reference datum on said translucent diffuser target screenn, and a video signal that is produced whenever said light spot is received by said television camera;

a first one-shot multivibrator, having an input effectively connected to the first sync signal output of said television signal processor and an output, for shaping said first sync signal, having whatever number of consecutive, uniformly spaced pulses, that is proportional to the vertical distance said spot is located from said predetermined horizontal reference datum on said translucent diffuser target screen;

a second one-shot multivibrator, having an input effectively connected to the second sync signal output of said television signal processor and an output, for shaping said second sync signal, having whatever number of consecutive, uniformly spaced pulses, that is proportional to the horizontal distance said spot is located from said predetermined vertical reference datum on said translucent diffuser target screen;

first means having a reset input, a clock input, and an output for counting the uniformly spaced pulses supplied to the clock input thereof between the occurrence of the uniformly spaced pulses supplied to the reset input thereof, with the reset input effectively connected to the output of said first one-shot multivibrator for response to the uniformly spaced pulses of said first sync signal, and with the clock input effectively connected to the output of said second one-shot multivibrator for response to the uniformly spaced pulses of said second sync signal;

means having an output for generating a clock signal containing a predetermined frequency of clock pulses;

second means having a reset input, a clock input, and an output for counting the clock pulses supplied to the clock input thereof between the occurrence of the uniformly spaced pulses supplied to the reset input thereof, with the reset input effectively connected to the output of said second one-shot multivibrator for response to the uniformly spaced pulses of said second sync signal, and with the clock input connected to the output of said predetermined clock signal generating means for response to the clock pulses produced thereby;

a first storage and hold register, having a data input connected to the output of said first pulse counting means, a gating and clearing input, and an output, for storing the uniformly spaced pulses of said first sync signal counted by said first pulse counting means;

a second storage and hold register, having a data input connected to the output of said second pulse counting means, a gating and clearing input and an output, for storing the uniformly spaced pulses of said second sync signal counted by said second pulse counting means;

a video sensing circuit having an input effectively connected to the video signal output of said television signal processor and an output effectively connected to the gating and clearing inputs of said first and second storage and hold registers for providing a gating signal to said first and second storage and hold registers;

a first digital-to-analog converter, having an input effectively connected to the output of said first storage and hold register and an output for converting the uniformly spaced pulses of said first sync signal into a first Cartesian coordinate signal proportional thereto;

a second digital-to-analog converter, having an input effectively connected to the output of said second storage and hold register and an output for converting the uniformly spaced pulses of said second sync signal into a second Cartesian coordinate signal proportional thereto; and means having a first input connected to the output of said first digital-to-analog converter, and a second input connected to the output of said second digital-to-analog converter, for reading out said first and second Cartesian coordinate signals as a point indication with respect to an indicated predetermined second horizontal reference datum and an indicated predetermined second vertical reference datum that correspond to said predetermined first and second reference datums, respectively.

11. The device of claim 10, wherein said means adapted for shooting a predetermined laser light beam in response to a predetermined first signal comprises a laser weapon.

12. The device of claim 10, wherein said television signal processor for converting the composite signal produced thereby into a first sync signal, having whatever number of consecutive, uniformly spaced pulses, that is proportional to the vertical distance said spot is located from said predetermined horizontal reference datum on said translucent diffuser target screen, a second sync signal, having whatever number of consecutive, uniformly spaced pulses, that is proportional to the horizontal distance said spot is located from said predetermined vertical reference datum on said translucent diffuser target screen, and a video signal that is produced whenever said light spot is received by said television camera, comprises a monolithic silicon integrated circuit television signal processor adapted for being incorporated in color and monochromatic television receivers.

13. The device of claim 10, wherein said first means having a reset input, a clock input, and an output for counting the uniformly spaced pulses supplied to the clock input thereof between the occurrence of the uniformly spaced pulses supplied to the reset thereof, with the reset input effectively connected to the output of said first one-shot multivibrator for response to uniformly spaced pulses of said first sync signal, and with the clock input effectively connected to an output of said second one-shot multivibrator for response to the uniformly spaced pulses of said second sync signal, comprises a first digital counter.

14. The device of claim 10, wherein said means for generating a clocl signal containing a predetermined frequency of clock pulses comprises a clock signal generator for producing a five million cycles per second clock signal.

15. The device of claim 10, wherein said second means having a reset input, a clock input, and an output for counting the clock pulses supplied to the clock input thereof between the occurrence of the uniformly spaced pulses supplied to the reset input thereof, with the reset input effectively connected to an output of said second one-shot multivibrator for response to the uniformly spaced pulses of said second sync signal, and with the clock input connected to the output of said predetermined clock signal generating means for response to the clock pulses produced thereby comprises a second digital counter.

16. The device of claim 10, wherein said means for reading out said first and second Cartesian coordinate signals as a point indication with respect to an indicated predetermined second horizontal reference datum and an indicated predetermined second vertical reference datum that corresponds to said predetermined first and second reference datums, respectively, comprises a target hit readout.

* * * * *